United States Patent [19]

Miyachi et al.

[11] Patent Number: 4,947,771

[45] Date of Patent: Aug. 14, 1990

[54] SEWING MACHINE

[75] Inventors: Nobuji Miyachi; Keniti Miyake, both of Kyoto, Japan

[73] Assignee: Hams Corporation, Kyoto, Japan

[21] Appl. No.: 241,576

[22] Filed: Sep. 8, 1988

[30] Foreign Application Priority Data

Sep. 12, 1987 [JP] Japan ..... 62-229223

[51] Int. Cl.[5] ..... D05B 35/04

[52] U.S. Cl. ..... 112/141; 112/121.26; 112/147; 112/272; 112/305; 112/322

[58] Field of Search ..... 112/121.26, 121.27, 112/10, 272, 141, 142, 143, 121.11, 277, 147, 305, 322, 63

[56] References Cited

U.S. PATENT DOCUMENTS

| | | | |
|---|---|---|---|
| 1,816,626 | 7/1931 | Weis | 112/121.26 |
| 3,752,100 | 8/1973 | Sharp . | |
| 3,865,058 | 2/1975 | Rovin et al. | 112/10 X |
| 4,046,087 | 9/1977 | Manetti | 112/121.26 X |
| 4,098,201 | 7/1978 | Adamski et al. | 112/121.26 X |
| 4,098,204 | 7/1978 | Kojima | 112/121.26 X |
| 4,265,187 | 5/1981 | Torre | 112/121.26 |
| 4,437,422 | 3/1984 | Torres | 112/272 |
| 4,473,017 | 9/1984 | Letard et al. | 112/121.26 X |
| 4,615,287 | 10/1986 | Henze et al. | 112/272 X |
| 4,669,848 | 5/1987 | Michaels et al. | 112/121.26 |
| 4,760,809 | 8/1988 | Nakatani et al. | 112/121.26 X |

FOREIGN PATENT DOCUMENTS

| | | |
|---|---|---|
| 1336401 | 11/1973 | United Kingdom . |
| 1557567 | 12/1979 | United Kingdom . |
| 0087327 | 1/1983 | European Pat. Off. . |
| 0177149 | 4/1986 | European Pat. Off. . |
| 58-138480 | 8/1983 | Japan . |

OTHER PUBLICATIONS

Singer 591, Union U-63900 M.

*Primary Examiner*—Peter Nerbun
*Attorney, Agent, or Firm*—Wenderoth, Lind & Ponack

[57] ABSTRACT

A sewing machine for making a threefold hem in each of the legs of a pair of trousers has a folding guide member for turning a bottom edge of the trouser leg inwardly of the trouser leg, a revolving roller positioned below the folding guide member for rocking motion in a direction rightwards and leftwards, and a detecting plate positioned above the folding guide member for the detection of the passage of at least one seam in the trouser legs over the folding guide member and movable up and down. When the bottom edge of each trouser leg having been folded to provide a double-layered bottom edge has been set on the machine and circumferentially stretched by the revolving roller, an inner fold of the double-layered bottom edge of the trouser leg is scooped up and folded inwardly by the folding guide to form a threefold hem and, during the continued revolution of the trouser leg in a direction circumferentially thereof by the action of the revolving roller, the detecting plate can detect the passage of the seam in the trouser leg, permitting the machine to initiate a stitching operation from a predetermined position preceding a sewing needle. After one complete revolution of the trouser leg and upon the detection of the passage of the seam by the detecting plate, the machine can terminate the stitching operation at a location which has passed a predetermined distance beyond the starting position.

2 Claims, 13 Drawing Sheets

SEWING MACHINE

BACKGROUND OF THE INVENTION

1. Field of the Invention:

The present invention generally relates to a sewing machine for automatically finishing a threefold hem at the bottom of each leg of a pant garment or trousers and, more particularly, to a hemming machine operable, when the trouser leg with its bottom edge having been folded twice inwardly is set on the machine, to automatically fold the double-folded bottom edge of the trouser leg again inwardly to provide a triple-folded bottom edge and then sew it to finish the threefold hem.

2. Description of the Prior Art

In order to avoid the loosening of textile yarns forming a fabric, the bottom edge of each leg of a pant garment or trousers P is, after having been inwardly triple-folded as indicated by M in FIG. 1, sewed to complete the threefold hem. In general, the stitch left marked by sewing threads used to complete the threefold hem extends circumferentially of the trouser leg with the starting and terminating ends of the stitch overlapped a distance of about 30 to 40 mm with each other, as indicated by W in FIG. 1, for the purpose of avoiding any possible slackening of the sewing threads. Moreover, to provide a well-tailored finish, the overlap W of the stitch is generally so designed as to extends an equal distance on respective sides of the inseam K in the trouser leg.

All of these steps of folding the bottom edge of each leg of the trousers P regardless of the number of the folds and sewing the triple-folded bottom edge thereof are carried out manually. More specifically, a needle-worker, before he or she does an actual sewing job to complete the triple-folded hem, has to manually fold the bottom edge of the trouser leg inwardly to form an overlapped bottom edge and, then, to do a job of causing the overlapped bottom edge to engage a guide, positioned forwardly of a presser foot of the sewing machine, for the formation of the triple-fold, followed by a job of actual sewing after the presser foot has been lowered to press the triple-fold between it and a feed dog of the sewing machine. These steps are laborintensive and time-consuming and, therefore, result in the increased cost of trouser making.

In view of the foregoing, a device has been proposed wherein the threefold hem can be automatically formed in each of the trouser legs, such as disclosed in the Japanese Laid-open Pat. Publication No. 58-138480, published in 1983. According to this prior art device, in order for the stitching, formed circumferentially around the trouser leg, to have its starting and terminating ends overlapping an equal distance on respective sides of the inseam in the trouser leg, utmost care is required for the worker to set the seam at a position a few centimeters preceding the position of the sewing needle. Not only does this require a lot of attentive efforts, but also the position at which the stitch is formed tends to deviate from the expected stitching line.

In addition, in order for the stitch, formed circumferentially of the trouser leg, to have the starting and terminating ends overlapped a distance of about 30 to 40 mm with each other, an accurate measurement of the circumference of the tubular bottom edge of the trouser leg is required. In order to accomplish this, a complicated control is required in that a deviation from a retracted position of a tensioning cylinder to a stretching position thereof has to be measured with the use of a sensor such as an encoder, and the measured value has to be subsequentlY multiplied by a predetermined coefficient to provide the circumference of the tubular bottom edge of the trouser leg for use in the determination of the number of stitches.

Moreover, in the prior art device, since a folding guide is provided at a position preceding the needle and a guide cylinder is fixedly supported at a position preceding the folding guide, there may be created a substantial distance to a supply idle roller positioned rearwardly of the needle and, therefore, it is difficult to insert a trouser leg of relatively small circumference exteriorly onto the device.

SUMMARY OF THE INVENTION

Accordingly, the present invention has been devised with the aim of substantially eliminating the above discussed problems and has for its object to provide an improved sewing machine wherein the threefold hem can be automatically formed in each of the trouser legs, with no margin to the seams being curled, by the use of, as the folding guide, a generally J-shaped guide rod formed by bending one end of a round rod to represent a generally semi-circular shape.

Specifically, in one aspect, the sewing machine according to one embodiment of the present invention has the feature that the folding guide rod formed by bending one end of a round rod so as to represent a generally J-shaped configuration and having a straight rod section and a curved rod section is positioned forwardly of a stitching direction with the straight rod section slidable in a direction orthogonal to the stitching direction so that the bottom edge of each trouser leg once folded inwardly of the respective trouser leg can be folded inwardly in engagement with the curved rod section to provide a threefold hem in the respective trouser leg.

Also, in another aspect, the sewing machine according to the present invention is provided with a difference-in-thickness detecting plate for the detection of the passage of a seam in the trouser leg (where the thickness of fabric is large) over the folding guide, positioned forwardly of the sewing needle, so that, when the seam in the trouser leg passes immediately below the detecting plate, the detecting plate can be raised to detect the passage of the seam in terms of the amount of deviation, thereby providing to a control unit a signal indicative of the detection of the seam. By this arrangement, when the bottom edge of the respective trouser leg is to be set on the sewing machine, the positioning of the seam in the respective trouser leg at a location about 10 to 20 mm forwardly of the sewing needle can permit the sewing machine to terminate the stitching at a location about 10 to 20 mm past the starting end of the stitch.

In a further aspect of the present invention, the present invention eliminates the necessity of the guide cylinder hitherto required in the prior art device. Instead thereof, a revolving roller which concurrently serves a tensioning and a guidance means is positioned immediately below the folding guide for movement from a retracted position to a tensioned position hitherto delimited by the guide cylinder used in the prior art device, so that the sewing machine can accommodate trousers having legs of varying circumference, particularly having slim legs of relatively small circumference.

More specifically, the sewing machine for circumferentially stitching each of the trouser legs while the fabric forming the trouser leg is fed below a sewing needle while sandwiched between upper and lower feed rollers comprises a folding guide having a curved groove for turning a bottom edge of the trouser leg inwardly of the trouser leg, an abutment ruler positioned rearwardly and laterally of the folding guide, a revolving roller having a one-way clutch and positioned below the folding guide for rocking motion in a direction rightwards and leftwards, and a detecting plate positioned above the folding guide for the detection of the passage of any one of seams in the trouser legs over the folding guide and movable up and down. In this construction, when and after the bottom edge of each trouser leg having been folded to provide a double-layered bottom edge has been set on the sewing machine and circumferentially stretched by the revolving roller, an inner fold of the double-layered bottom edge of the trouser leg can be scooped up and folded inwardly by the folding guide to form a threefold hem and, during the continued revolution of the trouser leg in a direction circumferentially thereof by the action of the revolving roller, the detecting plate can detect the passage of any one of the seams in the trouser leg, permitting the sewing machine to initiate a stitching operation from a predetermined position preceding a sewing needle. After one complete revolution of the trouser leg and upon the detection of the passage of the seam by the detecting plate, the sewing machine can terminate the stitching operation at a location at a predetermined distance beyond the starting position.

BRIEF DESCRIPTION OF THE DRAWINGS

These objects and features of the present invention will become clear from the following description taken in conjunction with preferred embodiments thereof with reference to the accompanying drawings:

FIGS. 1 to 18 illustrate a first preferred embodiment of the present invention, whereas FIGS. 19 to FIG. 34 illustrate a second preferred embodiment of the present invention, wherein:

FIG. 1 is a perspective view of a pair of trousers on which a sewing machine of the present invention forms a threefold hem at the bottom edge of each of the trouser legs;

FIG. 2 is a partial front elevational view of a first embodiment of the sewing machine according to the present invention;

FIG. 3 is a side view of the sewing machine shown in FIG. 2;

FIG. 4 is a top plan view, on an enlarged scale, of a folding guide used in the sewing machine;

FIG. 5 is a top plan view of a seam detecting mechanism used in the sewing machine;

FIG. 6 is a front elevational view of the seam detecting mechanism shown in FIG. 6;

FIG. 7 is a perspective view of the sewing machine showing a trouser ejecting mechanism;

FIGS. 8 to 11 are partial elevational views of the sewing machine showing the sequence of operation thereof;

FIGS. 12, 14 and 16 are diagrams illustrating the sequence in which an inner fold in the trouser leg is turned inwardly to provide a threefold hem, respectively;

FIGS. 13 is a cross-sectional view taken along the line C—C in FIG. 12;

FIG. 15 is a cross-sectional view taken along the line D—D in FIG. 14;

FIG. 17 is a cross-sectional view taken along the line E—E in FIG. 16;

FIG. 18 is a schematic diagram showing how a seam detecting plate detects the presence of a seam in the trouser leg;

FIG. 19 is a partial front elevational view of a second embodiment of the sewing machine according to the present invention;

FIG. 20 is a side view of the sewing machine shown in FIG. 19;

FIG. 21 is a top plan view of a seam detecting mechanism used in the sewing machine;

FIG. 22 is a front elevational view of the seam detecting mechanism shown in FIG. 21;

FIG. 23 is a partial front elevational view showing a folding guide rod formed for turning a double-layered bottom edge of the trouser leg outwardly;

FIGS. 25 to 28 are partial elevational views of the sewing machine showing the sequence of operation thereof;

FIGS. 29, 31 and 33 are diagrams illustrating the sequence in which an inner fold in the trouser leg is turned inwardly to provide the threefold hem, respectively; and FIGS. 30, 32 and 34 are cross-sectional views taken along the lines C—C, D—D and E—E shown in FIGS. 29, 31 and 33, respectively.

DETAILED DESCRIPTION OF THE EMBODIMENTS

Figure 2:
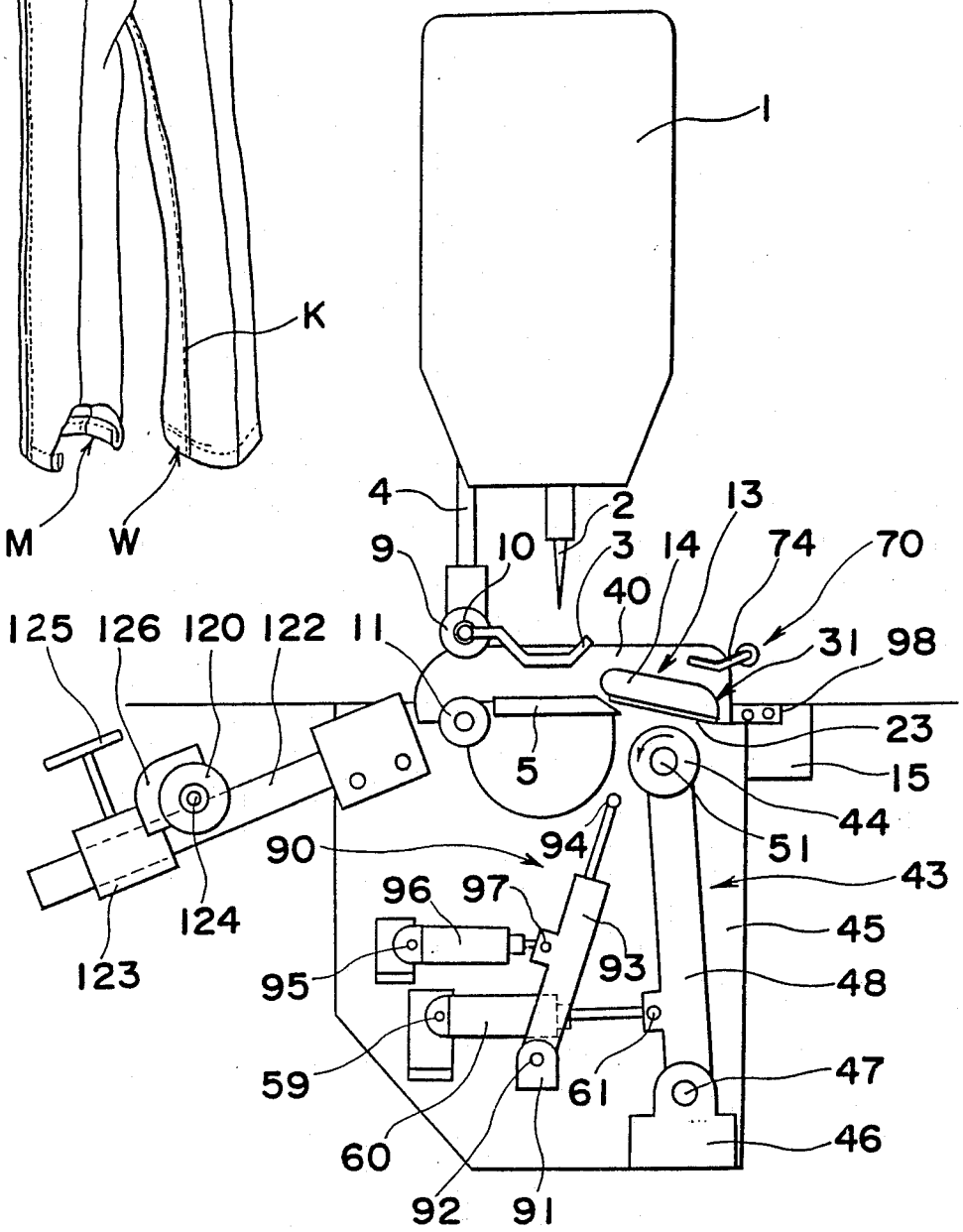

As shown in FIG. 2, a sewing machine 1 according to a first preferred embodiment of the present invention has a presser foot 3 slightly rockably supported at a lower end of a presser rod 4 positioned leftwards of a needle 2. This presser foot 3 is cooperable with a feed plate 5 on a machine bed 15 to clamp a web of textile fabric between the presser foot 3 and the feed plate 5 to retain it above the machine bed 15. The feed plate 5 is drivingly associated with the reciprocating motion of the needle 2 to move back and forth to feed the fabric web in one direction and, at the same time, the needle 2 forms a stitching. For facilitating a feed of the fabric web driven by the feed plate 5, an upper feed roller 9 is positioned leftwardly of the needle 2 and rotatably mounted at 10 to the lower end of the presser rod 4 and, on the other hand, a lower feed roller 11 is positioned on a left-hand side of the feed plate 5. When the presser rod 4 is lowered to clamp the fabric web between it and the feed plate 5, the upper feed roller 9 is simultaneously lowered to hold the fabric web between it and the lower feed roller 11 to feed the fabric web while the stitching is formed in the fabric web by the reciprocating up and down motion of the needle 2.

Figure 3:
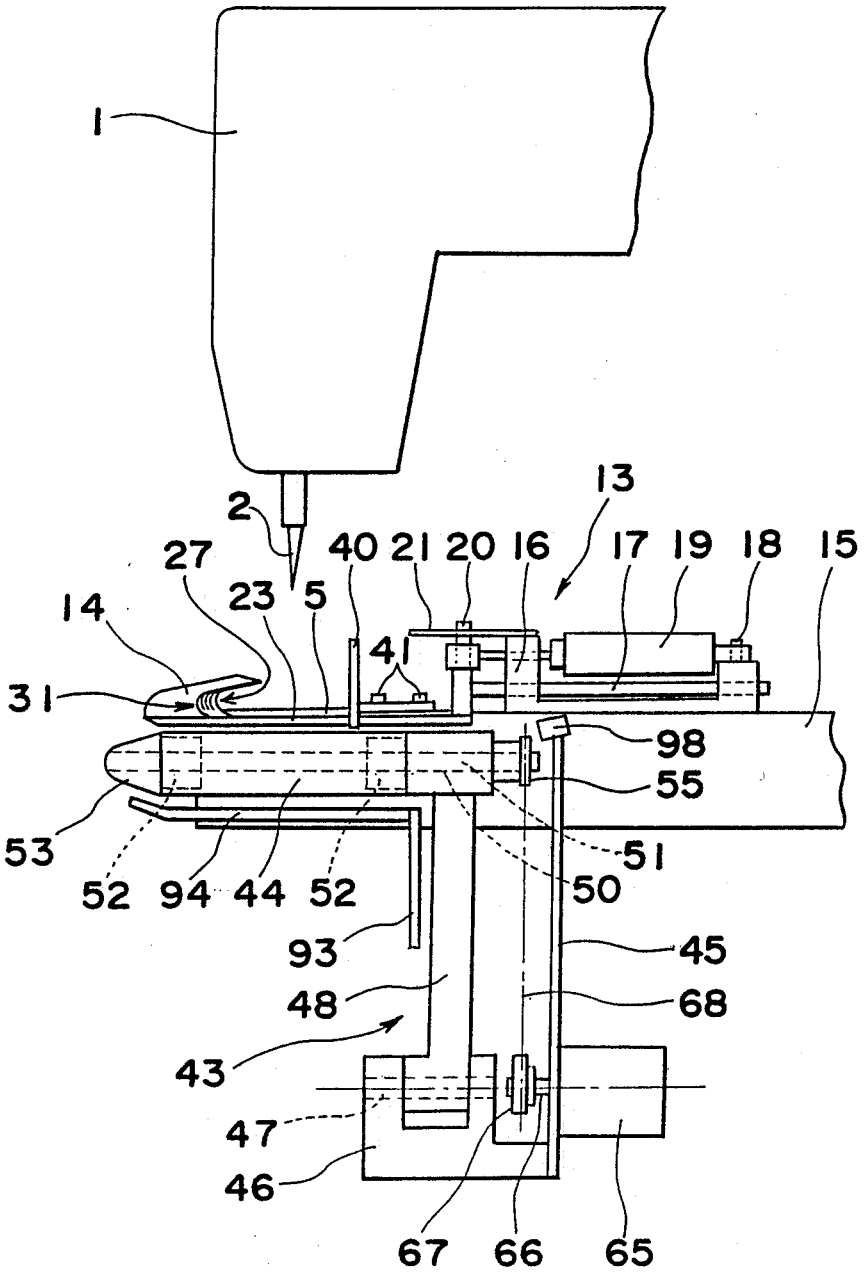

A folding mechanism generally identified by 13 is positioned rightwardly of the feed plate 5 for folding a double-folded bottom edge of each leg of the trousers P again inwardly to cause the double-folded bottom edge to become a threefold hem. This folding mechanism 13 comprises, as shown in FIG. 3, a bearing stock 16, mounted on the machine bed 15, and a slide shaft 17 slidably mounted on the bearing stock 16 so as to extend in a direction perpendicular to the stitching direction (leftward or rightward as viewed in FIG. 2). The slide shaft 17 has a first end coupled by a pin 20 with a pneumatic cylinder 19 which is journaled at 18 to a rear end of the bearing stock 16. The pin 20 has an upper end engaged in a slot 22 (See FIG. 5) which is defined in a stabilizer plate 21 fixed to a front end of the bearing stock 16.

Figure 4:
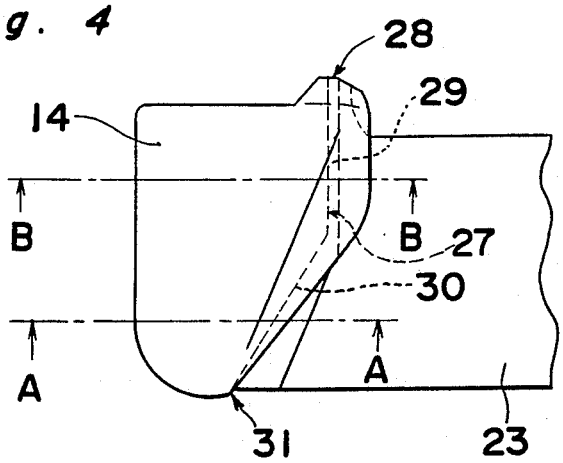
Figure 4A:
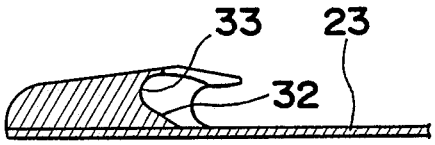
FIGS. 4A and 4B are cross-sectional views taken along the lines A-A and B-B in FIG. 4, respectively.

A slide plate 23 is positioned at the undersurface of the first end of the slide shaft 17 so as to extend rightwardly of the feed plate 5. As shown in FIG. 2, the slide plate 23 has a left-hand end positioned close to a right-hand end of the feed plate 5 and level with the upper surface thereof while inclined about 12° downwardly in a right-hand direction. A folding guide 14 is provided on an upper surface of a first end of the slide plate 23, which guide 14 has, as best shown in FIG. 3, a generally C-shaped folding groove 27 defined therein for folding the bottom edge of each leg of the trousers P in a manner as will be described later. As shown in FIG. 4, the generally C-shaped folding groove 27 is composed of a straight groove section 29 extending from an exit end 28 of the folding groove 27 in a direction parallel to the stitching direction, and an inclined groove section 30 continued from a terminating end of the straight groove section 29 and terminating at an inlet end 31 of the folding groove 28 while inclined leftwardly as viewed in FIG. 4. As best shown in FIG. 4A, the inclined groove section 30 is so configured and so shaped as to be delimited by a generally rounded wall 32 continued upwardly from the upper surface of the slide plate 23 and terminating at a generally upright wall 33.

Figure 4B:
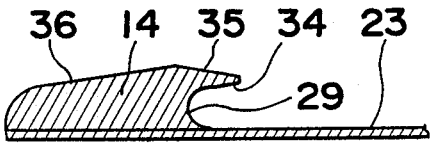

As shown in FIG. 4B, the straight groove section 29 is of a generally C-shaped cross-section extending from the upper surface of the slide plate 23 and terminating so as to form an overhang 34. The folding guide 14 has its upper surface composed of a rightwardly inclined slide surface region 35, positioned immediately above the straight groove section 29 and inclined rightwardly downwardly, and a leftwardly inclined slide surface region 36 continued from the slide surface region 35 and inclined leftwardly downwardly, the joint between the slide surface region 36 and the upper surface of the slide plate 23 being rounded to provide a smooth slide surface.

Reference numeral 40 represents a ruler plate against which the double-folded bottom edge of each leg of the trousers P is engaged when it has been placed on the machine bed 15. As best shown in FIG. 3, this ruler plate 40 is a single plate member positioned rearwardly of the needle 2 as viewed in FIG. 2 and perpendicular to the feed plate 5 with its surface extending from the inlet end 31 of the folding guide 14 to past the lower feed roller 11 in a direction substantially parallel to the stitching direction.

Figure 5:
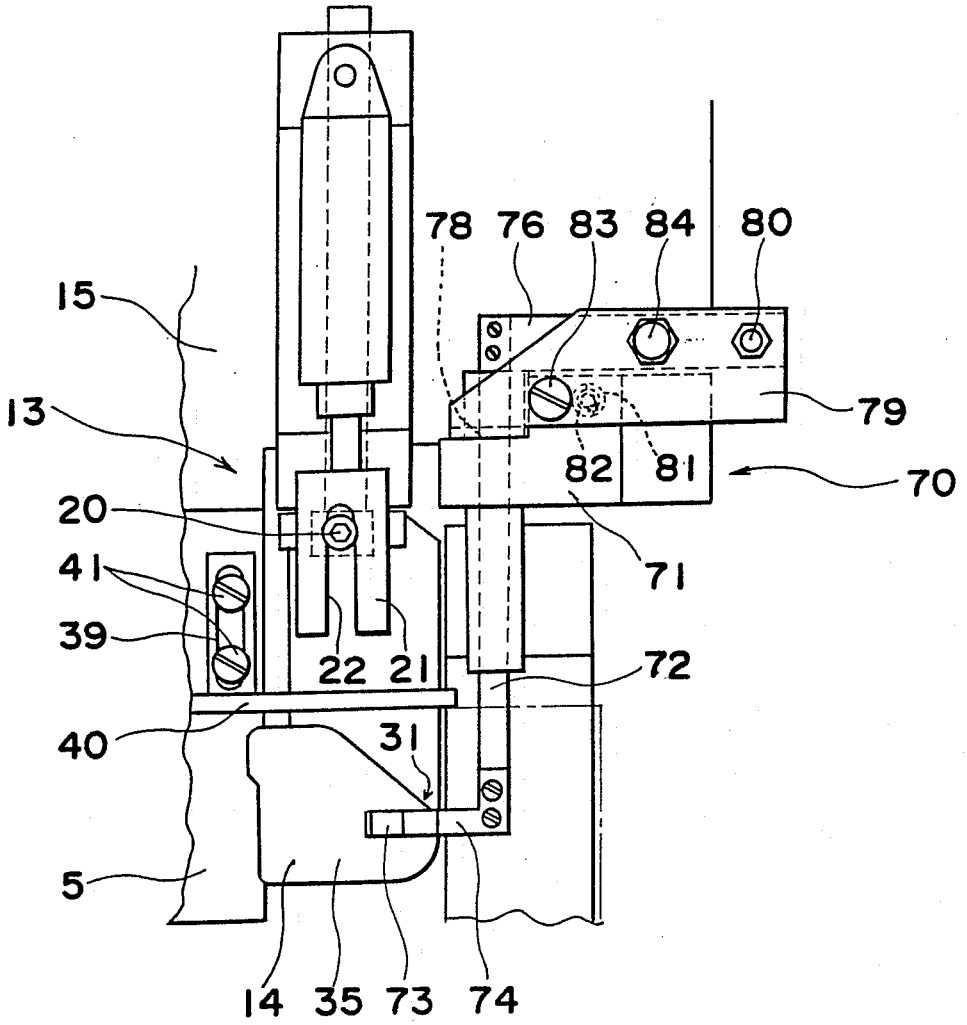

As shown in FIGS. 3 and 5, the ruler plate 40 has a rear horizontal portion formed with a slot 39 and is adjustably mounted on the machine bed 15 by means of adjustment screws 41 extending through the slot 39 and threaded to the machine bed 15. It is to be noted that the position of the ruler plate 40 relative to the needle 2 can be adjusted by loosening and, then, tightening the adjustment screws 41.

A revolving mechanism 43 for revolving the trouser leg to be stitched about the machine bed 15 with respect to the needle 2 while the trouser leg is mounted therearound is positioned generally immediately below the folding guide 14. As best shown in FIGS. 2 and 3, this revolving mechanism 43 comprises a rocker lever 48 having a lower end pivoted at 47 to a bearing block 46 secured to a lower end of that upright plate 45 which is secured to the machine bed 15. This rocker lever 48 is pivotable about the pivot 47 in a direction leftwards and rightwards, that is, in a direction generally parallel to the stitching direction.

The rocker lever 48 has its upper end terminating immediately beneath the flat plate 23 and carries a horizontal shaft 51 having one end rotatably connected to the upper end of the rocker lever 48 through a bearing 50, provided on such upper end of the rocker lever 48, so as to extend in a direction perpendicular to the stitching direction. The horizontal shaft 51 has a free end protruding outwardly from a front end of the bearing 50 and terminating generally below the folding guide 14. On this free end of the horizontal shaft 51, a roller 44 for revolving the tubular trouser leg in a manner as will be described later is mounted through a one-way clutch 52. A stopper collar 53 for avoiding any possible separation of the roller 44 from the horizontal shaft 51 is positioned frontwardly of the revolving roller 44. Because of this, when the horizontal shaft 51 rotates in a direction as indicated by the arrow as shown in FIG. 2 and conforming to the stitching direction, the revolving roller 44 is coupled by the one-way clutch 52, then in a coupling position, with the horizontal shaft 51 for rotation together with the horizontal shaft 51, but when the horizontal shaft 51 is held still without being rotated, the revolving roller 44 can rotate idle in a direction conforming to the stitching direction. As shown in FIG. 3, a rear end of the horizontal shaft 51 protrudes outwardly from a rear end of the bearing 50 and has a sprocket wheel 55 rigidly mounted thereon for rotation together therewith.

A substantially intermediate portion of the rocker lever 48 is coupled through a connecting pin 61 with a pneumatic cylinder 60 pivotally mounted at 59 to the upright plate 45. Reciprocating motion of a piston of the pneumatic cylinder 60 results in the pivotal movement of the rocker lever 48 about the pivot 47. Specifically, the piston of the pneumatic cylinder 60 projects, the rocker lever 48 is pivoted clockwise as viewed in FIG. 2 with the revolving roller 44 consequently moved from a retracted position, defined generally immediately below the folding guide 14, towards a tensioning position defined rightwardly of the retracted position thereby to hold the trouser leg under tension in cooperation with the upper and lower feed rollers 9 and 11.

The revolving roller 44 has its outer peripheral surface lined with a layer of polyurethane rubber for avoiding any possible slippage between the revolving roller 44 and the fabric forming the trouser leg when the trouser leg is revolved in contact with the revolving roller 44 for circulating the trouser leg with respect to the needle 2.

As shown in FIG. 3, a drive motor 65 for driving the horizontal shaft 51 is carried by a lower end of the upright plate 45, having a drive shaft 66 thereof positioned in coaxial relationship with the pivot 47 about which the rocker lever 48 pivots. This drive shaft 66 of the drive motor 65 has a sprocket wheel 67 rigidly mounted for rotation together therewith, said sprocket wheel 67 being drivingly coupled with the sprocket wheel 55 by means of an endless drive chain 68 trained therebetween.

Figure 1:
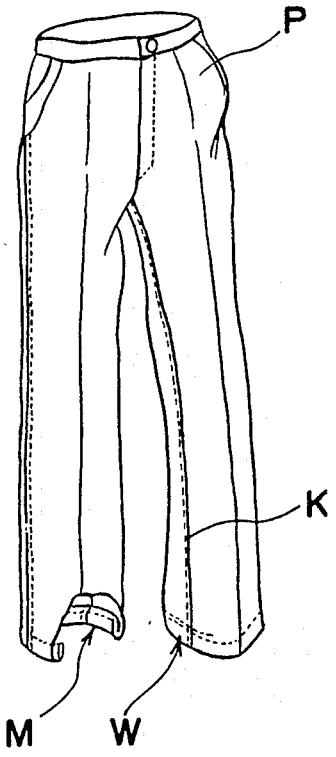
Figure 6:
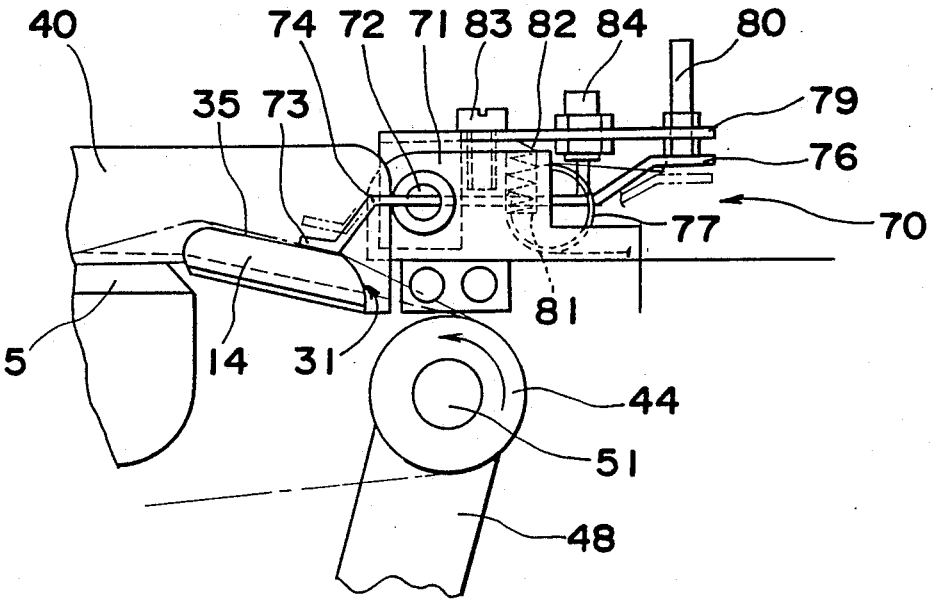

Positioned rightwardly of the folding mechanism 13 is a seam detecting mechanism 70 for automatically detecting the presence of the inseam K (FIG. 1) in the trouser leg. This seam detecting mechanism 70 comprises, as shown in FIGS. 5 and 6, a horizontal shaft 72 rotatably mounted on a bearing block 71, and a detecting plate 74 secured to a front end of the horizontal shaft 72 and having a feeler 73 at a front end thereof remote from the horizontal shaft 72 for touching the fabric forming the trouser leg. The detecting plate 74 is so positioned and so supported as to permit the feeler 73 to assume a position immediately above the inlet end 31 of the folding guide 14. A rotary plate 76 is secured to a rear end of the horizontal shaft 72 and is normally biased by a coil spring 77, extending between a substantially central portion of the rotary plate 76 and a lower end of the bearing 71, so as to be raised upwardly with its free end held in contact with a switch 80. This switch 80 is secured to a free end of a retaining piece 79 rotatably connected at 78 to the rear end of the bearing 71 in coaxial relationship with the horizontal shaft 72. The retaining piece 79 is normally biased upwardly by a compression spring 82 accommodated within a hole 81 defined in the rear end of the bearing 71, and, by adjusting an adjustment screw 83 provided at a generally central portion thereof, the extent to which the feeler 73 of the detecting plate 74 is held in contact with the fabric forming the trouser leg can be adjusted.

A pneumatic cylinder 84 for pressing the rotary plate 76 downwards is fixedly mounted on the retaining piece 79. This pneumatic cylinder 84 has a piston and, when this piston is projected, the rotary plate 76 can be rotated downwards to raise the feeler 73 of the detecting plate 74 through the horizontal shaft 72 to prevent any possible interference of the trouser leg with the detecting plate 74 when the trouser leg is placed on the machine bed 15.

As shown in FIG. 2, a hem retaining mechanism 90 is provided below the revolving roller 44. This hem retaining mechanism 90 is operable, when and after the bottom portion of the trouser leg has been placed around a sewing portion of the sewing machine with the intended stitching line aligned with the needle 2, to hold the bottom portion of the trouser leg under tension in cooperation with a horizontal bar 94 positioned inside the trouser leg as will be described later.

Figure 8:
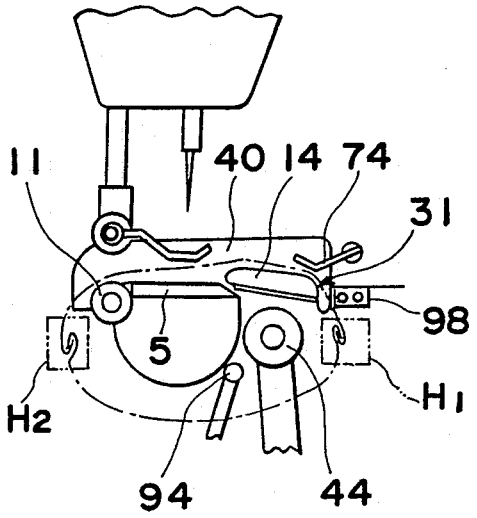

The hem retaining mechanism 90 referred to above is employed for the purpose of avoiding the following problem. When an operator of the sewing machine, after having folded the bottom edge of the trouser leg inwardly of the trouser leg, places the folded bottom edge of the trouser leg around that sewing portion of the sewing machine as shown by the phantom line in FIG. 8 while holding the folded bottom edge of the trouser leg with his or her hands H1 and H2 as shown in FIG. 8, and when the revolving roller 44 is then moved rightwards (towards a stretched position), the hand H1 of the operator holding the folded bottom edge of the trouser leg from inside will be pinched between the revolving roller 44 and the fabric forming the trouser leg.

Figure 9:
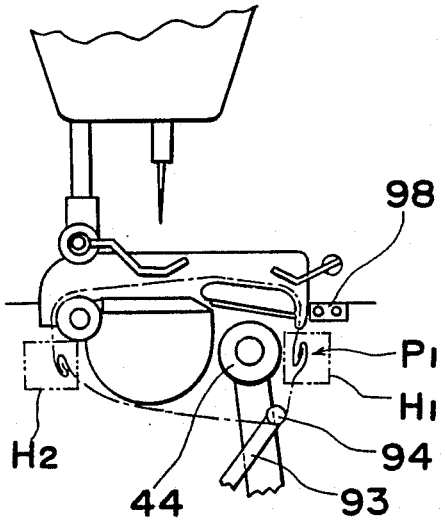
Figure 10:
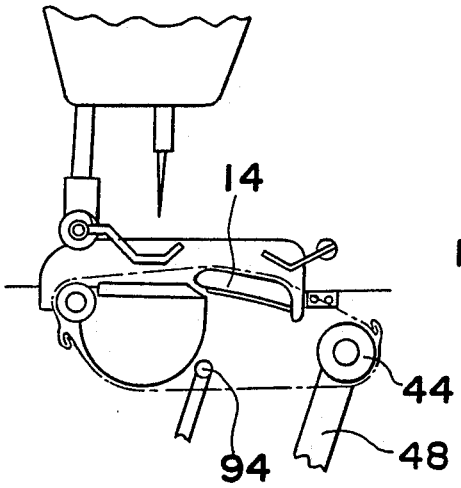

In order to avoid the above discussed problem, the horizontal bar 94 is utilized to stretch and hold the trouser leg from inside in a manner as best shown in FIG. 9 at a location spaced a distance of about 100 mm downwardly from the inlet end 31 of the folding guide 14, so that the removal of the hand H1 will not result in separation of the trouser leg from that sewing portion of the sewing machine. In this arrangement, the movement of the revolving roller 44 towards the stretched position is effected after the withdrawal of the hand H1 from the trouser leg. After the revolving roller 44 has been moved to the stretched position as shown in FIG. 10, the horizontal bar 94 is allowed to disengage from the trouser leg. It is, however, to be noted that the horizontal bar 94 is not always required in the practice of the present invention and, if desired, it may be dispensed with.

As shown in FIG. 2, the hem retaining mechanism 90 comprises a bearing 91 provided at the lower end of the upright plate 45 and a pivotable lever 93 pivotably supported by the bearing 91 through a pivot shaft 92. As shown in FIG. 3, the pivotable lever 93 is positioned forwardly of and parallel to the rocking lever 48 and extends so as to terminate in the vicinity of a rear end of the revolving roller 44 with its free end to which a rear end of the horizontal bar 94 is rigidly secured. This horizontal bar 94 so secured to the free end of the pivotable lever 93 extends so as to terminate in the vicinity of a front end of the revolving roller 44. A substantially intermediate portion of the pivotable lever 93 is coupled through a connecting pin 97 with a piston of a pneumatic cylinder 96 having its rear end pivotally secured at 95 to the upright plate 45. Thus, when the piston of the pneumatic cylinder 96 is projected, the pivotable lever 93 pivots rightwards with the horizontal bar 94 consequently stretching the trouser leg from inside. As best shown in FIGS. 2 and 3, a photo-electric switch assembly 98 is provided rightwardly and forwardly of the machine bed 15 for detecting the presence or absence of the operator's hand inserted at the time of the placement of the trouser leg around that sewing portion of the sewing machine. More specifically, this photo-electric switch 98 is utilized to detect the hand when the hand is inserted to a position about 50 mm below the inlet end of the folding guide 14 and will provide an output signal to a control unit when the operator withdraws his or her hand therefrom after the stretching accomplished by the horizontal bar 94.

Figure 7:
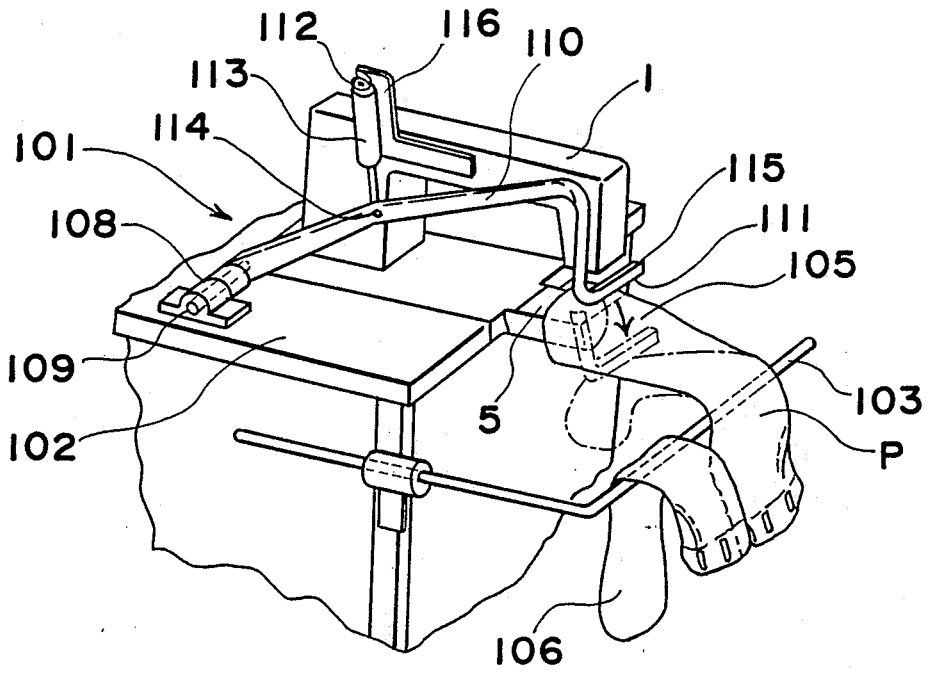

Referring to FIG. 7, provided at a left-hand portion of the sewing machine as viewed in this figure is an ejecting mechanism 101 operable to withdraw from that sewing portion of the machine the trouser leg after the threefold hem has been formed.

This ejecting mechanism 101 comprises a bearing 108 provided at a rear portion of a machine table 102, and a shaped arm 110 which is mounted on the bearing 108 through a pivot shaft 109 so as to extend parallel to the machine 1. A free end of this shaped arm 110 is positioned frontwardly of the sewing machine and is formed with a horizontal arm section 115 laterally bent so as to be positioned about 50 mm diagonally upwardly from and forwardly of the feed plate 5. The horizontal arm section 115 has its undersurface lined with a rubber plate 111 for increasing frictional resistance between it and the fabric forming the trouser leg.

A substantially intermediate portion of the shaped arm 110 is coupled through a connecting pin 114 with a piston of a pneumatic cylinder 113 pivotally connected at 112 to a bracket 116 fixed to a side portion of the sewing machine 1. When the piston of the pneumatic cylinder 113 is projected, the shaped arm 110 is rotated in the direction shown by the arrow with the horizontal arm section 115 consequently operated to eject the trouser leg 105 from the sewing machine in a manner as shown by the phantom line in FIG. 7.

Referring still to FIG. 7, a working bar 103 is provided forwardly of the machine table 102 horizontally traversing the front of the sewing machine 1. The working bar 103 is used to support the trousers P to avoid the hanging of the trousers and to avoid the necessity of the operator supporting the full weight of the trousers P during the sewing operation. In other words, arrangement has been made such that, during the length of time in which one of the trouser legs 105 is stitched to form the threefold hem, the operator folds the other of the trouser legs 106 inwardly to provide the double-folded bottom edge in readiness for the next succeeding sewing operation during which such the other of the trouser legs is stitched to complete the threefold hem, while such one of the trouser legs 105 after having been formed with the threefold hem is automatically removed from that sewing portion of the machine by the action of the shaped arm 110.

An idle roller 120 is, as shown in FIG. 2, arranged leftwardly of the sewing machine 1 as seen in this figure to make the sewing machine capable of accommodating the trouser leg of a relatively large circumference (for example, of a circumference within the range of 420 to 600 mm). Specifically, this idle roller 120 is utilized in the event that the use of only the revolving roller 44 will not cause the trouser leg to be sufficiently stretched. This idle roller 120 has its outer peripheral surface lined with a layer of polyurethane rubber as is the case with the revolving roller 44.

This idle roller 120 is rotatably mounted at 124 on a movable member 123 movably mounted on a guide shaft 122 which is secured to the upright plate 45. The movement of the movable member 123 relative to the guide shaft 122, that is, the position of the idle roller 120, can be adjusted by loosening a generally T-shaped screw member 125 threadingly mounted atop the movable member 126. The movable member 123 is also provided with a regulating member 126 mounted atop the movable member 123 for movement in a direction to and fro along the idle roller 120 for the adjustment of the position of the hem in each leg of the trousers P.

The sequence of operation of the sewing machine of the construction hereinbefore described is controlled by a sequence control scheme. Specifically, it operates in the following manner.

Assuming that the operator has folded the bottom edge of the trouser leg inwardly to provide the twofold hem, the operator, while holding the trouser leg with his or her hands H1 and H2 in the manner as shown > in FIG. 8, has to place the trouser leg on that sewing portion of the machine 1 so as to cause the twofold hem to encircle exteriorly of the feed plate 5, the folding guide 14, the revolving roller 44, the horizontal bar 94 and the lower feed roller 11 as shown by the phantom line in FIG. 8. After the twofold hem in the trouser leg has been positioned against the scale plate 40, depression of a foot-operated switch (not shown) results in the protrusion of the piston of the pneumatic cylinder 96 of the hem retaining mechanism 90 with the consequence that, as shown in FIG. 9, the pivotable lever 93 is pivoted rightwards with the horizontal bar 94 stretching the circumference of the trouser leg from inside as shown by the phantom line in FIG. 9.

Figure 12:
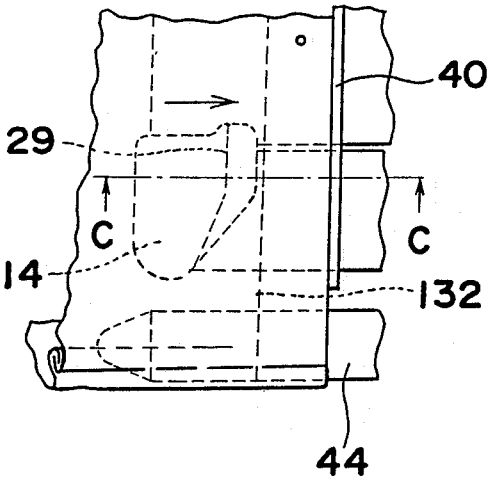

When the operator subsequently withdrawn his or her hands H1 and H2, the photo-electric switch assembly 98 detects the movement of the hand H1 to provide an output signal by which the pneumatic cylinder 60 of the revolving mechanism 43 is actuated to project the piston, causing the rocking lever 48 to move rightwards as shown in FIGS. 10 and 12 with the revolving roller 44 held in contact with the trouser leg from inside thereby stretching the twofold hem. Simultaneously with or shortly after the initiation of the stretching of the hem P1, shown in FIG. 9, in a direction rightwards, the horizontal bar 94 is returned to the initial position shown in FIG. 8.

Figure 14:
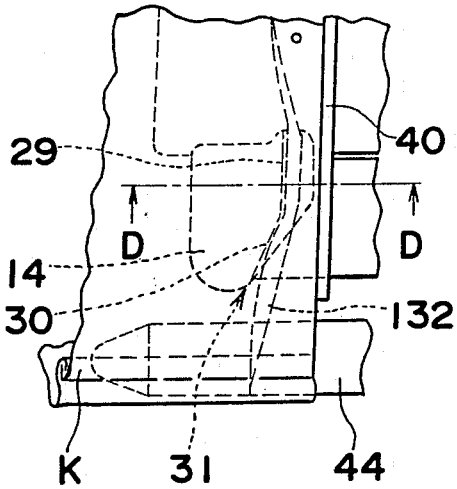
Figure 13:
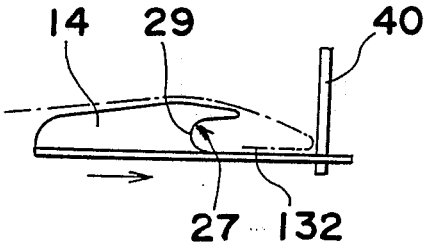
Figure 15:
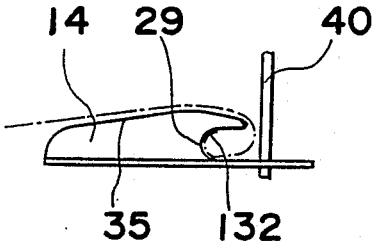

Then, the piston of the pneumatic cylinder 19 of the folding mechanism 13 is retracted to withdraw the folding guide 14 rearwardly from the position shown in FIGS. 12 and 14 in the direction shown by the arrow. As the folding guide 14 is thus withdrawn rearwardly, the inner fold 132 of the twofold hem in the trouser leg is scooped up to follow the curvature of the folding groove 27 until the inner fold 132 is again folded back to form a three-layered bottom edge of the trouser leg in the manner as shown in FIGS. 14 and 15. During the formation of this three-layered bottom edge in the trouser leg, the inner fold 182 is scooped from a condition shown in FIGS. 12 and 13 up along the curved surface of the folding groove 27 and as the folding guide 14 continues its movement in the direction shown by the arrow, the free circumferential edge of the inner fold 132 reaches the overhang 34, having been guided upwardly along the curved wall defining the straight groove section 29, and is folded back while guided again along the curved wall defining the straight groove section 29 until the free circumferential edge thereof is moved a distance corresponding to about two thirds of the curvature of the wall defining the straight groove section 29 as shown in FIG. 15.

After the formation of the three-layered hem, the piston of the pneumatic cylinder 84 of the seam detecting mechanism 70 is retracted to bring the rotary plate 76 into contact with the switch 80 and, at the same time, to rotate the detecting plate 74 through the horizontal shaft 72 with the feeler 73 being consequently brought into contact with that portion of the three-layered hem, shown by the phantom line in FIG. 6, which is then moving along the slide surface region 35 of the folding guide 14.

Figure 16:
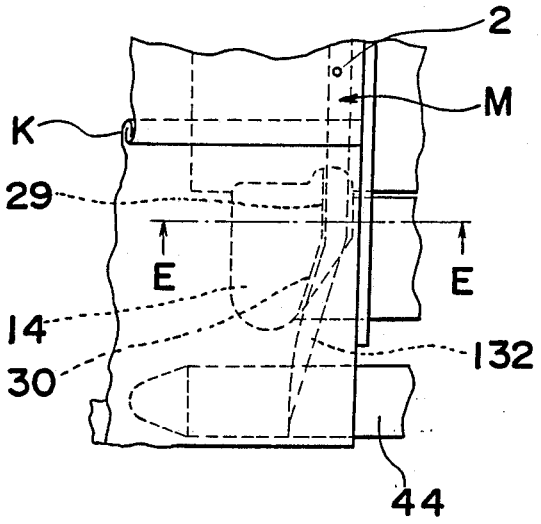
Figure 17:
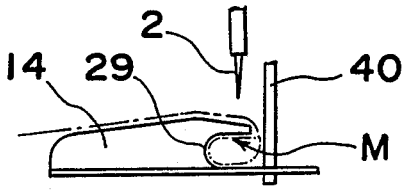

Thereafter, the drive motor 65 of the revolving mechanism 43 is driven to drive the endless chain 68 to rotate the horizontal shaft 51 in the direction shown by the arrow. The rotation of the horizontal shaft 51 in the direction shown by the arrow brings the one-way clutch 52 into the coupling position and, therefore, the revolving roller 44 is driven to circulate the trouser leg in the direction conforming to the stitching direction. During this circulation of the trouser leg, a portion of the inner fold 132 entering the inlet end 31 of the folding guide 14 is drawn deep inwardly, as it, passes along the inclined groove section 30, and turned upwardly to fold inwards until it reaches the boundary between the inclined groove section 30 and the straight groove section 29. The inner fold 132 can be completely folded inwardly to provide the three-layered hem in the trouser leg when it is finally passed along the straight groove section 29 as shown in FIGS. 16 and 17.

Figure 11:
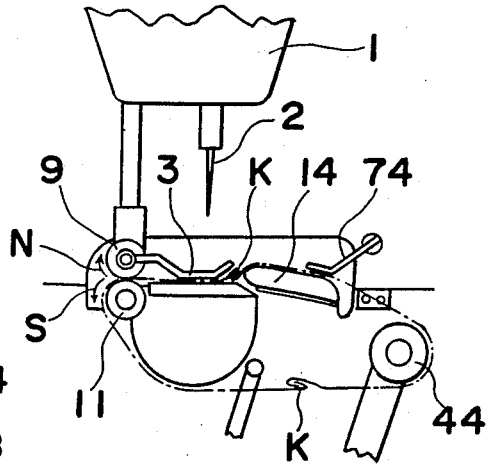

Also, during the circulation of the trouser leg, and as one of seams K in the trouser leg passes beneath the feeler 73 of the detecting plate 74, the detecting plate 74 is raised to a position as shown by the phantom line in FIG. 6, the motion of the feeler 73 being transmitted through the horizontal shaft 72 to the rotary plate 76 to rotate the latter downwards so as to separate from the switch 80. When the rotary plate 76 is separated from the switch 80 a distance of about 1 mm or greater, a signal indicative of the detection of the passage of the seam over the slide surface region 35 of the folding guide 14 is supplied to the control unit whereby the control unit is activated to stop the drive motor 65 when, as shown in FIG. 16, the seam K is brought to a predetermined position forwardly of the needle 2, that is, spaced about 10 to 20 mm preceding the needle 2 with respect to the direction of circulation of the trouser leg. At this time, as shown in FIGS. 16 and 17, a leading portion of the threefold hem M reaches a position immediately below the needle 2, followed by the lowering of both of the upper feed roller 9 and the presser foot 3, and the sewing machine 1 is then started with the upper and lower feed rollers 9 and 11 driven in respective directions shown by N and S in FIG. 11. Therefore, the three-layered hem of the trouser leg can, while clamped between the upper and lower rollers 9 and 11, is fed leftwards to initiate the stitching operation.

Figure 18:
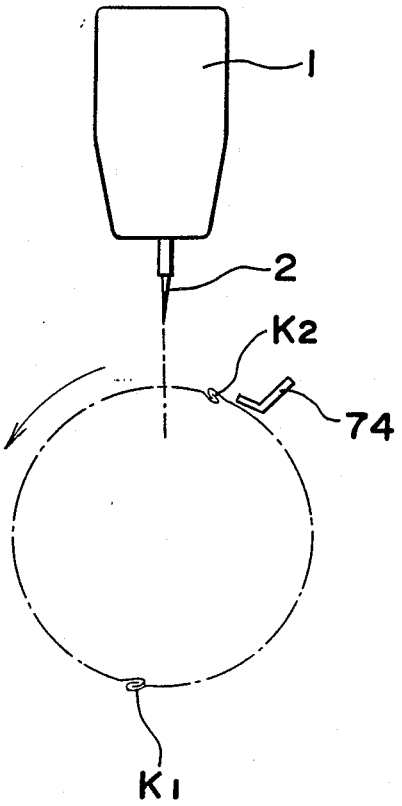

In the event that, during the stitching operation the seam K passes immediately below the detecting plate 74, the control unit is caused by the detection signal to count the seams K. When the count reaches a predetermined value, for example, if a digital switch for counting the number of the seams is set to 2 where each trouser leg has a pair of opposite seams shown by K1 and K2 (See FIG. 18), that is, the inseam and the outseam, a timing control is activated, when the seam K2 passes below the detecting plate 74 subsequent to the passage of the seam K1 therebelow incident to the circulation of the trouser leg, causing the pneumatic cylinder 19 of the folding mechanism 13 to retract its piston. Upon the retraction of the piston of the pneumatic cylinder 19, the folding guide 14 is returned from a folding position, shown in FIG. 14, back to the retracted position shown in FIG. 12 and, at the same time, the timing control which a predetermined number of stitches corresponding to the distance of 10 to 20 mm over which the seam K2 is fed from the position of the needle 2 is activated, when the seam K2 has moved such distance from the position of the needle 2, to stop the sewing machine. In this way, stitching extending an equal distance of 10 to 20 mm on respective sides of the seam K2 is formed thereby to complete the threefold hem in the trouser leg.

Thereafter, the sewing machine 1 performs a thread cutting operation and then raises both of the upper roller 9 and the presser foot 3. Then the piston of the pneumatic cylinder 60 of the revolving mechanism 43 is retracted to bring the revolving roller 44 back to the retracted position thereby to permit the trouser leg to be slackened. Subsequently, the piston of the pneumatic cylinder 113 of the ejecting mechanism 101 is projected to rotate the shaped arm 110 in the direction shown by the arrow in FIG. 7 with the horizontal arm section 115 depressing the threefold hem 105 from above so that the threefold hem of the trouser leg is removed out from the feed plate 5 and the folding guide 14 as shown by the phantom line.

In this way, one cycle of sewing operation is completed. The operator having folded the bottom edge of the other of the trouser legs to form the double-layered bottom edge has to place the other of the trouser legs on the sewing machine 1 to form the threefold hem on the other of the trouser legs during the next succeeding cycle of sewing operation.

As hereinbefore fully described, according to the present invention, when and after the operator has folded the bottom edge of the trouser leg inwardly to provide the twofold hem and then sets it on the sewing machine, the sequence of retaining, revolving, triple-folding and stitching of the trouser leg is automatically performed by the sewing machine to complete the threefold hem.

Also, according to the present invention, the provision of the detecting mechanism 70 for the detection of the presence or absence of the seams K in the trouser leg, which mechanism 70 operates to set the seam K forwardly of the detecting plate 74, makes it possible to accurately form the threefold hem having the stitching which extends circumferentially of the trouser leg with the starting and terminating ends overlapped and extending uniformly an equal distance on respective sides of the seam K in the trouser leg.

While the formation of the threefold hem in the trouser leg according to the prior art method has taken about 16 seconds, the use of the sewing machine according to the present invention has made it possible to form the threefold hem in about 6 seconds and is effective to provide an efficiency approximately twice or more than that when the stitching is performed manually.

In addition, the provision of the revolving roller 44 positioned immediately beneath the folding guide 14 for pivotal movement between the projected and retracted positions accomplished by the guide cylinder makes it possible to accommodate the trousers having a pair of legs of relatively small diameter.

Hereinafter, another preferred embodiment of the present invention will be described with reference to FIGS. 19 to 34.

Figure 19:
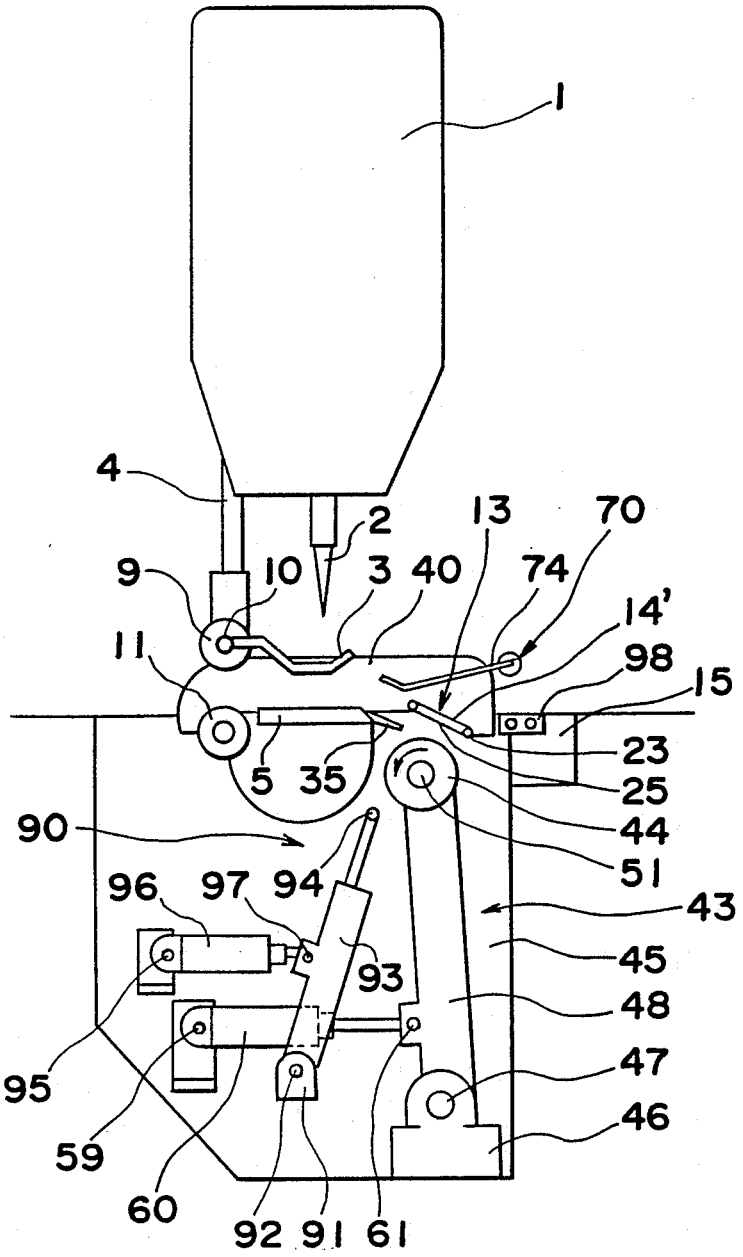

As shown in FIG. 19, a sewing machine 1 according to a second preferred embodiment of the present invention has a presser foot 3 slightly rockably supported at a lower end of a presser rod 4 positioned leftwards of a needle 2. This presser foot 3 is cooperable with a feed plate 5 on a machine bed 15 to clamp a web of textile fabric between the presser foot 3 and the feed plate 5 to retain it above the machine bed 15. The feed plate 5 is drivingly associated with the reciprocating motion of the needle 2 to move back and forth to feed the fabric web in one direction and, at the same time, the needle 2 forms a stitching. For facilitating the feed of the fabric web driven by the feed plate 5, an upper feed roller 9 is positioned leftwardly of the needle 2 (see FIG. 19) and rotatably mounted at 10 to the lower end of the presser rod 4 and, on the other hand, a lower feed roller 11 is positioned on a left-hand side of the feed plate 5. When the presser rod 4 is lowered to clamp the fabric web between it and the feed plate 5, the upper feed roller 9 is simultaneously lowered to hold the fabric web between it and the lower feed roller 11 to feed the fabric web while the stitching is formed in the fabric web by the reciprocating up and down motion of the needle 2.

Figure 20:
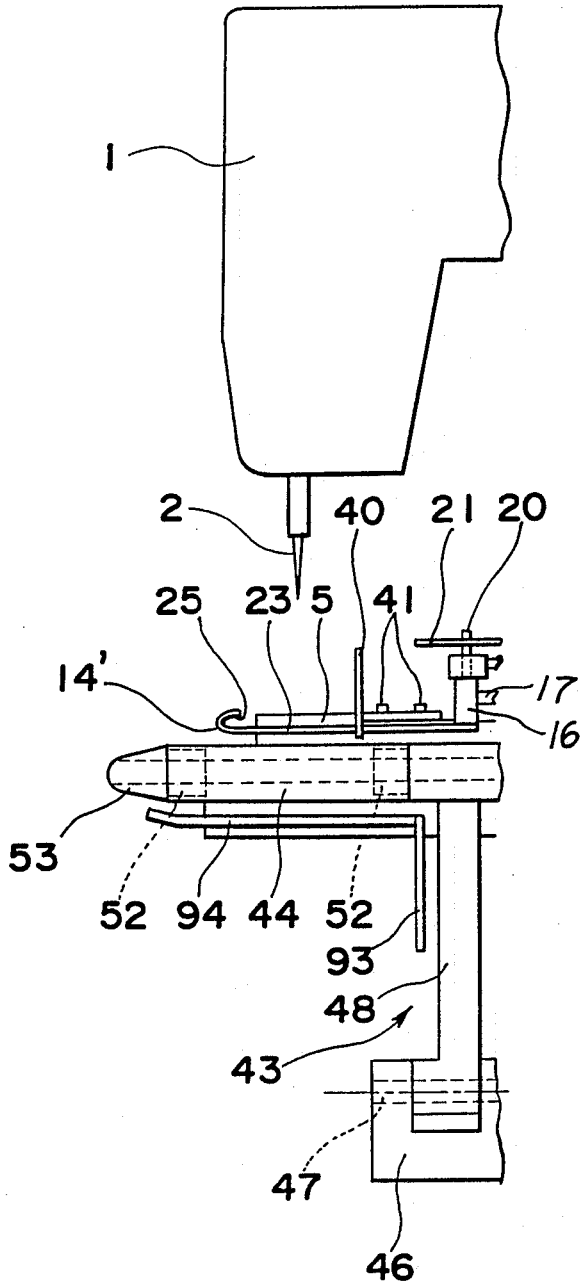

A generally J-shaped folding mechanism generally identified by 13 is positioned rightwardly of the feed plate 5 for folding a double-folded bottom edge of each leg of the trousers P again inwardly to form the double-folded bottom edge into a threefold hem. This folding mechanism 13 comprises, as shown in FIG. 20, a bearing stock 16, mounted on the machine bed 15, and a slide shaft 17 slidably mounted on the bearing stock 16 so as to extend in a direction perpendicular to the stitching direction (leftward or rightward as viewed in FIG. 20). The slide shaft 17 has a first end coupled by a pin 20 with a pneumatic cylinder 19 which is journaled at 18 to a rear end of the bearing stock 16. The pin 20 has an upper end engaged in a slot 22 (See FIG. 21) which is defined in a stabilizer plate 21 fixed to a front end of the bearing stock 16.

Figure 27:
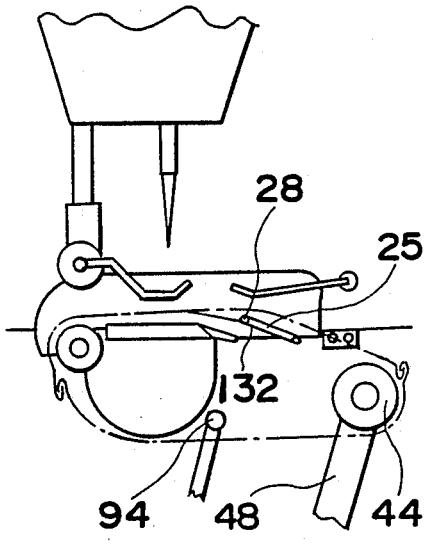
Figure 30:
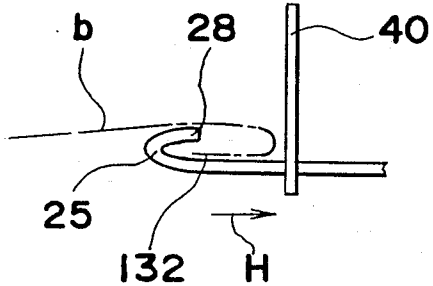

A generally J-shaped folding guide rod 14' formed by bending a rod member into a generally semi-circular shape and having a straight rod section 23 and a curved rod section 25 (the radius of curvature of which is about 11 mm) is provided at a first end of the slide shaft 17 with the straight rod section 23 lying parallel to the feed plate 5 and with the curved rod section 25 confronting and spaced above the feed plate 5 as shown in FIG. 19. Specifically, as shown in FIGS. 27 and 30, after the double-layered bottom edge of the trouser leg (shown by the phantom line) has been stretched by the revolving roller 44 so as to contact an upper surface of the curved rod section 25, the curved rod section 25 can hook the inner fold 132 of the trouser leg while drawing it inwardly thereof as the guide rod 14' is withdrawn.

Figure 23:
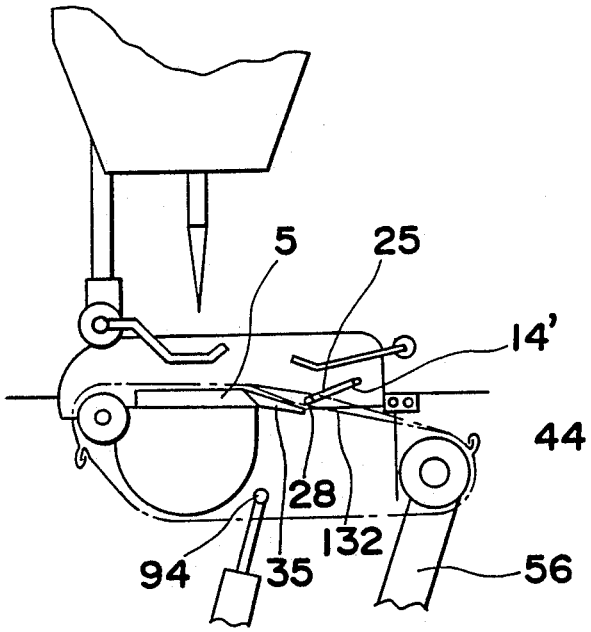
Figure 24A:
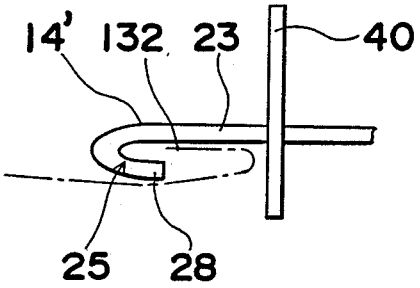
FIG. 24A is a diagram showing the folding guide rod of FIG. 23 held in position ready to fold an outer edge of the trouser leg.
Figure 24B:
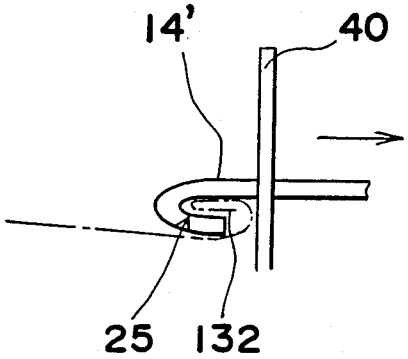
FIG. 24B is a diagram showing the folding guide rod of FIG. 23 performing the folding operation to form a threefold hem positioned exteriorly of the trouser leg.

In the case where the bottom edge of the trouser leg is folded exteriorly thereof, as shown in FIGS. 23 and 24A, the free end 28 of the curved rod section 25 is so positioned and fixed beneath the upper surface of the feed plate 5, in a manner substantially reverse to that described above in connection with the case in which the fold 132 is positioned inside the trouser leg, that, after the double-layered bottom edge of the trouser leg has been stretched by the revolving roller 44 so as to contact the lower region of the curved rod end 28, the curved rod section 25 can hook the fold 132 of the trouser leg while drawing it inwardly thereof as the guide rod 14' is withdrawn in the direction shown by the arrow in FIG. 24B.

Figure 24C:
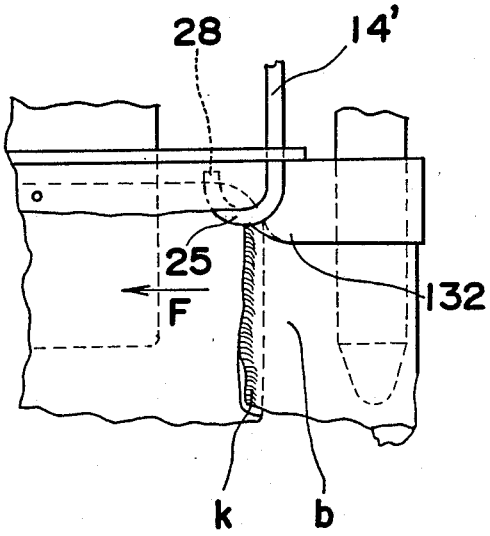
FIG. 24C is a partial top plan view showing the seam in the trouser leg being moved past a curved portion of the folding guide rod.

To explain the case in which the bottom edge of the trouser leg is folded exteriorly thereof, as shown in FIG. 24C, a round end portions (of about 4 mm in diameter) of the curved rod end 28 positioned exteriorly of the trouser leg is inserted in between the fold 1 and a portion b of the trouser leg. Accordingly, as the trouser leg is circumferentially revolved in the direction shown by the arrow F, a margin of the seam K in that portion b of the fabric is passed without being curled and, on the other hand, the fold 132 is curved inwardly along the curvature of the semi-circular shape of the curved rod section 25.

Reference numeral 40 represents a ruler plate with which the double-folded bottom edge of each leg of the trousers P is engaged when it has been placed on the machine bed 15. As best shown in FIG. 20, this ruler plate 40 is a single plate member positioned rearwardly of the needle 2 so as to extend perpendicular to the feed plate 5 with its surface extending from the straight rod section 23 of the folding guide rod 14' to the left-hand side of the lower feed roller 11 in a direction substantially parallel to the stitching direction.

Figure 21:
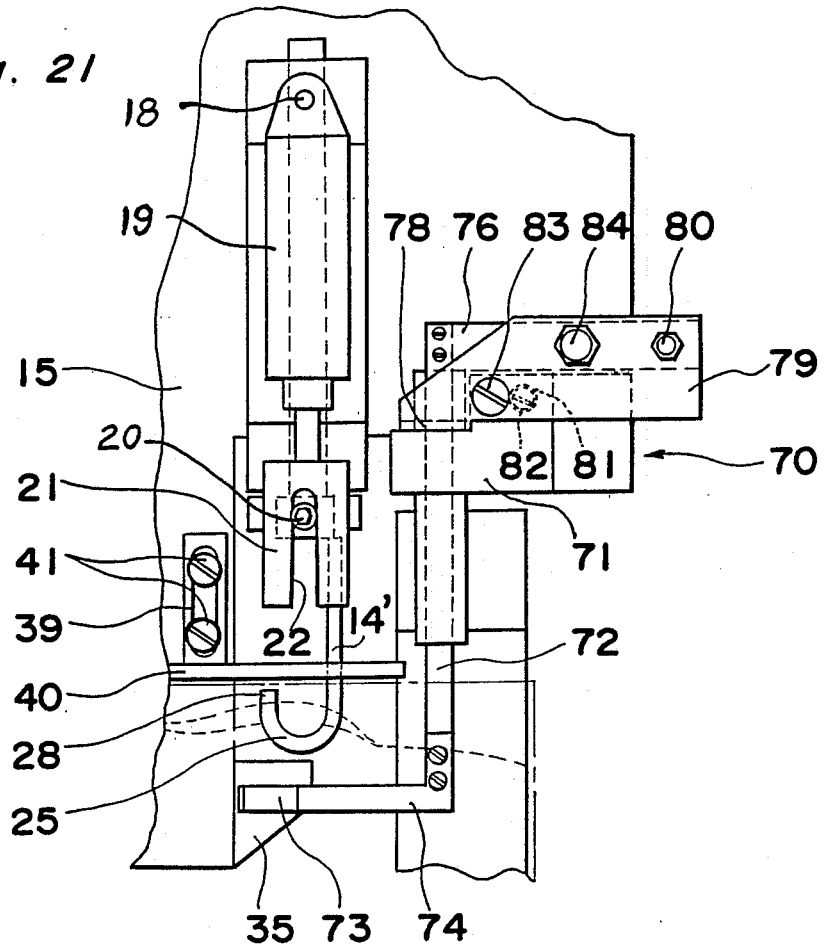

As shown in FIGS. 20 and 21, the ruler plate 40 has at its rear portion a slot 39 and is adjustably mounted on the machine bed 15 by means of adjustment screws 41 extending through the slot 39 and threaded to the machine bed 15. It is to be noted that the position of the ruler plate 40 relative to the needle 2 can be adjusted by loosening and, then, tightening the adjustment screws 41.

A revolving mechanism 43 for revolving the trouser leg to be stitched about the machine bed 15 with respect to the needle 2 while the trouser leg is mounted therearound is positioned generally immediately below the folding guide rod 14'. As best shown in FIGS. 19 and 20, this revolving mechanism 43 comprises a rocker lever 48 having a lower end pivoted at 47 to a bearing block 46 secured to a lower end of that upright plate 45 which is secured to the machine bed 15. This rocker lever 48 is pivotable about the pivot 47 in a direction leftwards and rightwards, that is, in a direction generally parallel to the stitching direction.

The rocker lever 48 has its upper end terminating immediately beneath the straight rod section 23 and carries a horizontal shaft 51 having one end rotatably connected to the upper end of the rocker lever 48 through a bearing 50, provided on such upper end of the rocker lever 48, so as to extend in a direction perpendicular to the stitching direction. The horizontal shaft 51 has a free end protruding outwardly from a front end of the bearing 50 and terminating generally below the folding guide rod 14'. On this free end of the horizontal shaft 51, a roller 44 for revolving the tubular trouser leg in a manner as will be described later is mounted through a one-way clutch 52. A stopper collar 53 for avoiding any possible separation of the roller 44 from the horizontal shaft 51 is positioned frontwardly of the revolving roller 44. Because of this, when the horizontal shaft 51 rotates in a direction as indicated by the arrow and conforming to the stitching direction, the revolving roller 44 is coupled by the one-way clutch 52, then in a coupling position, with the horizontal shaft 51 for rotation together with the horizontal shaft 51, but when the horizontal shaft 51 is held still without being rotated, the revolving roller 44 can rotate idly in a direction corresponding to the stitching direction. As shown in FIG. 20, the rear end of the horizontal shaft 51 protrudes outwardly from a rear end of the bearing 50 and has a sprocket wheel 55 rigidly mounted thereon for rotation together therewith.

A substantially intermediate portion of the rocker lever 48 is coupled through a connecting pin 61 with a pneumatic cylinder 60 pivotally mounted at 59 to the upright plate 45. Reciprocating motion of a piston of the pneumatic cylinder 60 results in the pivotal movement of the rocker lever 48 about the pivot 47. Specifically, the piston of the pneumatic cylinder 60 projects, the rocker lever 48 is pivoted clockwise as viewed in FIG. 19 with the revolving roller 44 consequently being moved from a retracted position, defined generally immediately below the folding guide rod 14', towards a tensioning position defined rightwardly of the retracted position thereby to hold the trouser leg under tension in cooperation with the upper and lower feed rollers 9 and 11.

The revolving roller 44 has its outer peripheral surface covered with a layer of polyurethane rubber for avoiding any possible slippage between the revolving roller 44 and the fabric forming the trouser leg when the trouser leg is revolved in contact with the revolving roller 44 for circulating the trouser leg with respect to the needle 2.

As shown in FIG. 20, a drive motor 65 for driving the horizontal shaft 51 is carried by a lower end of the upright plate 45, having a drive shaft 66 thereof positioned in coaxial relationship with the pivot 47 about which the rocker lever 48 pivots. This drive shaft 66 of the drive motor 65 has a sprocket wheel 67 rigidly mounted for rotation together therewith, said sprocket wheel 67 being drivingly coupled with the sprocket wheel 55 by means of an endless drive chain 68 trained therebetween.

Figure 22:
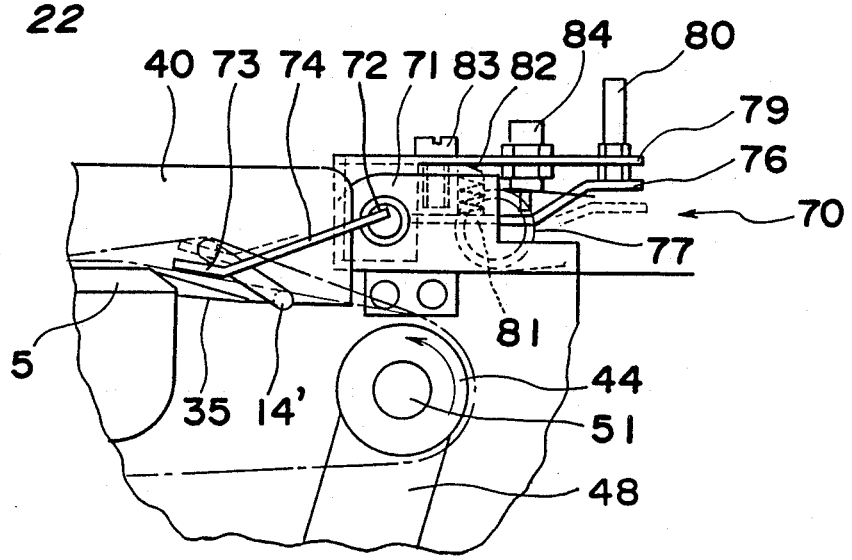

Positioned rightwardly of the folding mechanism 13 is a seam detecting mechanism 70 for automatically detecting the passage of the seam K (FIG. 1) in the trouser leg thereby. This seam detecting mechanism 70 comprises, as shown in FIGS. 21 and 22, a horizontal shaft 72 rotatably mounted on a bearing block 71, and a detecting plate 74 secured to a front end of the horizontal shaft 72 and having a feeler 73 at a front end thereof remote from the horizontal shaft 72 for touching the fabric forming the trouser leg. The detecting plate 74 is so positioned and so supported as to permit the feeler 73 to assume a position immediately above a fabric support 35 formed at a right-hand end of the feed plate 5. A rotary plate 76 is secured to a rear end of the horizontal shaft 72 and is normally biased by a coil spring 77, extending between a substantially central portion of the rotary plate 76 and a lower end of the bearing 71, so as to be raised upwardly with its free end held in contact with a switch 80. This switch 80 is secured to a free end of a retaining piece 79 rotatably connected at 78 to the rear end of the bearing 71 in coaxial relationship with the horizontal shaft 72. The retaining piece 79 is normally biased upwardly by a compression spring 82 accommodated within a hole 81 defined in the rear end of the bearing 71, and, by adjusting an adjustment screw 83 provided at a generally central portion thereof, the pressure with which the feeler 73 of the detecting plate 74 is held in contact with the fabric forming the trouser leg can be adjusted.

A pneumatic cylinder 84 for pressing the rotary plate 76 downwards is fixedly mounted on the retaining piece 79. This pneumatic cylinder 84 has a piston and, when this piston is projected, the rotary plate 76 can be rotated downwards to raise the feeler 73 of the detecting plate 74 through the horizontal shaft 72 to prevent any possible interference of the trouser leg with the detecting plate 74 when the trouser leg is placed on the machine bed 15.

As shown in FIG. 19, a hem retaining mechanism 90 is provided below the revolving roller 44. This hem retaining mechanism 90 is operable, when and after the bottom portion of the trouser leg has been placed around a sewing portion of the sewing machine with the intended stitching line aligned with the needle 2, to hold the bottom portion of the trouser leg under tension in cooperation with a horizontal bar 94 positioned inside the trouser leg as will be described later.

Figure 25:
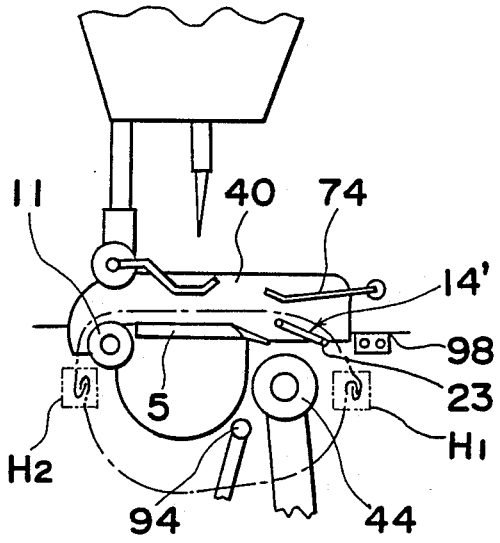

The hem retaining mechanism 90 referred to above is employed for the purpose of avoiding the following problem. When an operator of the sewing machine, after having folded the bottom edge of the trouser leg inwardly of the trouser leg, places the folded bottom edge of the trouser leg around that sewing portion of the sewing machine as shown by the phantom line in FIG. 25 while holding the folded bottom edge of the trouser leg with his or her hands H1 and H2 as shown in FIG. 25, and when the revolving roller 44 is then moved rightwards (towards a stretched position), the hand H1 of the operator holding the folded bottom edge of the trouser leg from inside will be pinched between the revolving roller 44 and the fabric forming the trouser leg.

Figure 26:
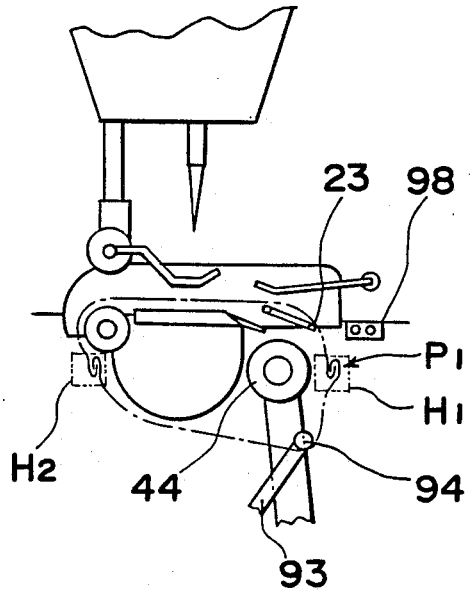
Figure 28:
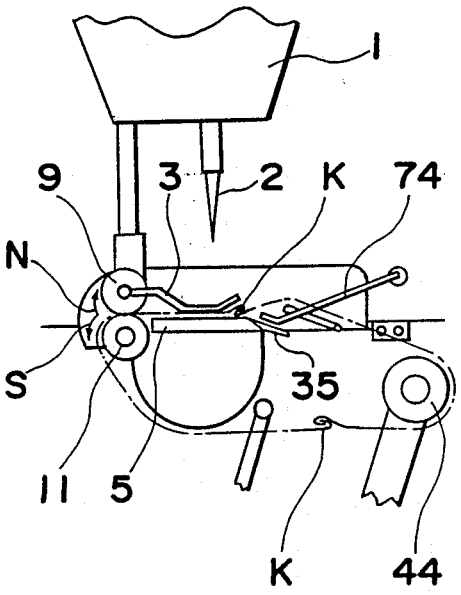

In order to avoid the above discussed problem, the horizontal bar 94 is utilized to stretch and hold the trouser leg from inside in a manner as best shown in FIG. 26 at a location spaced a distance of about 100 mm downwardly from the straight rod section 23 of the folding guide rod 14', so that the removal of the hand H1 will not result in separation of the trouser leg from that sewing portion of the sewing machine. In this arrangement, the movement of the revolving roller 44 towards the stretched position is effected after the withdrawal of the hand H1 from the trouser leg. After the revolving roller 44 has been moved to the stretched position as shown in FIG. 26, the horizontal bar 94 is disengaged from the trouser leg. It is, however, to be noted that the horizontal bar 94 is not always required in the practice of the present invention and, if desired, it may be dispensed with.

As shown in FIG. 19, the hem retaining mechanism 90 comprises a bearing 91 provided at the lower end of the upright plate 45 and a pivotable lever 93 pivotably supported by the bearing 91 through a pivot shaft 92. As shown in FIG. 20, the pivotable lever 93 is positioned forwardly of and parallel to the rocking lever 48 and extends so as to terminate in the vicinity of a rear end of the revolving roller 44 with its free end to which a rear end of the horizontal bar 94 is rigidly secured. This horizontal bar 94 so secured to the free end of the pivotable lever 93 extends so as to terminate in the vicinity of a front end of the revolving roller 44. A substantially intermediate portion of the pivotable lever 93 is coupled through a connecting pin 97 with a piston of a pneumatic cylinder 96 having its rear end pivotally secured at 95 to the upright plate 45. Thus, when the piston of the pneumatic cylinder 96 is projected, the pivotable lever 93 pivots rightwards with the horizontal bar 94 consequently stretching the trouser leg from inside.

As best shown in FIGS. 19 and 20, a photo-electric switch assembly 98 is provided rightwardly and forwardly of the machine bed 15 for detecting the presence or absence of the operator's hand inserted at the time of the placement of the trouser leg around that sewing portion of the sewing machine. More specifically, this photo-electric switch 98 is utilized to detect the hand when the hand is inserted to a position about 50 mm below the straight rod section 23 of the folding guide rod 14' and will provide an output signal to a control unit when the operator withdraws his or her hand therefrom after the stretching accomplished by the horizontal bar 94.

The sequence of operation of the sewing machine of the construction hereinbefore described is controlled by a sequence control scheme. Specifically, it operates in the following manner.

Assuming that the operator has folded the bottom edge of the trouser leg inwardly to provide the twofold hem, the operator, while holding the trouser leg with his or her hands H1 and H2 in the manner as shown in FIG. 25, has to place the trouser leg on that sewing portion of the machine 1 so as to cause the twofold hem to encircle exteriorly of the feed plate 5, the folding guide rod 14', the revolving roller 44, the horizontal bar 94 and the lower feed roller 11 as shown by the phantom line in FIG. 25. After the twofold hem in the trouser leg has been positioned against the scale plate 40, depression of a foot-operated switch (not shown) results in the protrusion of the piston of the pneumatic cylinder 96 of the hem retaining mechanism 90 with the consequence that, as shown in FIG. 26, the pivotable lever 93 is pivoted rightwards with the horizontal bar 94 stretching the circumference of the trouser leg from inside as shown by the phantom line in FIG. 26.

When the operator subsequently withdraw his or her hands H1 and H2, the photo-electric switch assembly 98 detects the movement of the hand H1 to provide an output signal by which the pneumatic cylinder 60 of the revolving mechanism 43 is actuated to project the piston, causing the rocking lever 48 to move rightwards as shown in FIGS. 27 with the revolving roller 44 held in contact with the trouser leg from inside thereby stretching the twofold hem. Simultaneously with or shortly after the initiation of the stretching of the hem Pl, shown in FIG. 26, in a direction rightwards, the horizontal bar 94 is returned to the initial position shown in FIG. 25.

Figure 31:
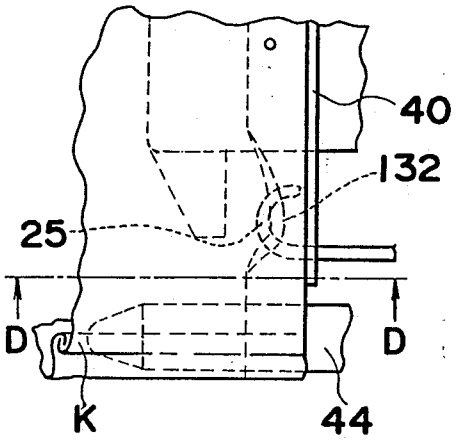
Figure 32:
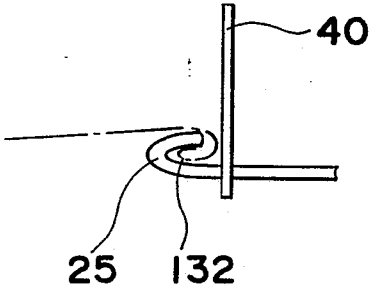
Figure 29:
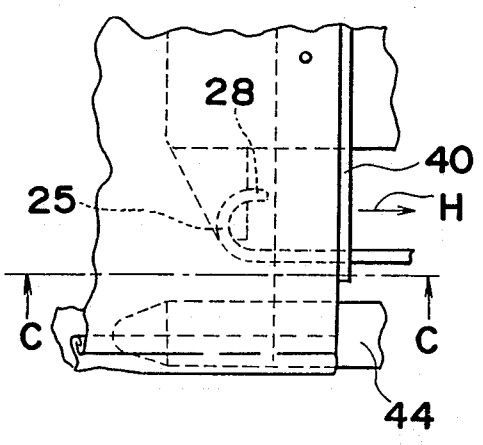

Then, the piston of the pneumatic cylinder 19 of the folding mechanism 13 is retracted to withdraw the folding guide rod 14' rearwardly from the position shown in FIGS. 29 and 30 in a direction shown by the arrow H. As the folding guide rod 14' is so withdrawn rearwardly, the inner fold 132 of the twofold hem in the trouser leg is scooped up to follow the curvature of the curved rod section 25 until the inner fold 132 is again folded back to form a three-layered bottom edge of the trouser leg in a manner as shown in FIGS. 31 and 32. After the formation of the three-layered hem, the piston of the pneumatic cylinder 84 of the seam detecting mechanism 70 is retracted to bring the rotary plate 76 into contact with the switch 80 and, at the same time, to rotate the detecting plate 74 through the horizontal shaft 72 with the feeler 73 consequently brought into contact with that portion of the three-layered hem which is then moving along the slide surface region 35 of the folding guide rod 14'.

Figure 33:
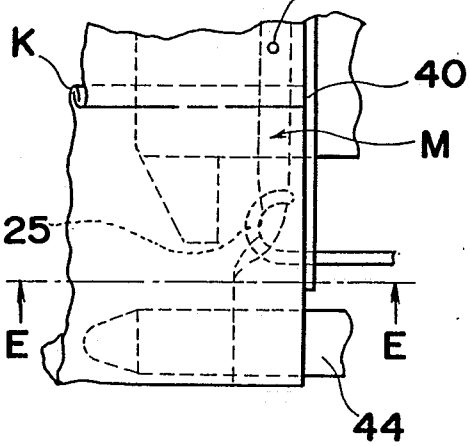
Figure 34:
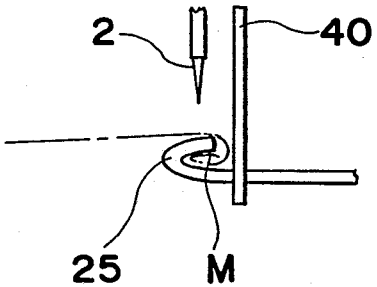

Thereafter, the drive motor 65 of the revolving mechanism 43 is driven to drive the endless chain 68 to rotate the horizontal shaft 51 in the direction shown by the arrow. The rotation of the horizontal shaft 51 in the direction shown by the arrow brings the one-way clutch 52 into the coupling position and, therefore, the revolving roller 44 is driven to circulate the trouser leg in the direction conforming to the stitching direction. During this circulation of the trouser leg, a portion of the inner fold 132 entering the curved rod section 25 of the folding guide rod 14' is drawn deep inwardly, as it is moved past the curved rod section 25, and turned upwardly to fold inwards, with the consequence that the inner fold 132 is completely folded inwardly to provide the three-layered hem in the trouser leg when it is finally moved past the curved rod section 25 as shown in FIGS. 33 and 34.

Also, during the circulation of the trouser leg, and as one of seams K in the trouser leg passes beneath the feeler 73 of the detecting plate 74, the detecting plate 74 is raised to a position as shown by the phantom line in FIG. 22, the motion of the feeler 73 being transmitted through the horizontal shaft 72 to the rotary plate 76 to rotate the latter downwards so as to separate from the switch 80. When the rotary plate 76 is separated from the switch 80 a distance of about 1 mm or greater, a signal indicative of the detection of the passage of the seam over the slide surface region 35 of the folding guide rod 14' is supplied to the control unit whereby the control unit is activated to stop the drive motor 65 when, as shown in FIG. 33, the seam K is brought to a predetermined position forwardly of the needle 2, that is, spaced about 10 to 20 mm preceding the needle 2 with respect to the direction of circulation of the trouser leg. At this time, as shown in FIGS. 33 and 34, a leading portion of the threefold hem M reaches a position immediately below the needle 2, followed by the lowering of both of the upper feed roller 9 and the presser foot 3, and the sewing machine 1 is then started with the upper and lower feed rollers 9 and 11 driven in respective directions shown by N and S in FIG. 28. Therefore, the three-layered hem of the trouser leg is, while clamped between the upper and lower rollers 9 and 11, be fed leftwards to initiate the stitching operation.

In the event that, during the stitching operation being performed, the seam K passes immediately below the detecting plate 74, the control unit is caused by the detection signal to count the seams K. When the count reaches a predetermined value, for example, if a digital switch (not shown) for counting the number of the seams is set at 2 where each trouser leg has a pair of opposite seams shown by K1 and K2 (See FIG. 18), that is, the inseam and the outseam, as is the case in the previously described embodiment of the present invention, a timing control is activated, when the seam K2 passes below the detecting plate 74 subsequent to the passage of the seam K1 therebelow incident to the circulation of the trouser leg, causing the pneumatic cylinder 19 of the folding mechanism 13 to project its piston. Upon the projection of the piston of the pneumatic cylinder 19, the folding guide rod 14' is returned from a folding position, shown in FIG. 31, back to the retracted position shown in FIG. 29 and, at the same time, the timing control which a predetermined number of stitches corresponding to the distance of 10 to 20 mm over which the seam K2 is fed from the position of the needle 2 is activated, when the seam K2 has moved such distance from the position of the needle 2, to stop the sewing machine. In this way, the stitching extending an equal distance of 10 to 20 mm on respective sides of the seam K2 is formed thereby to complete the threefold hem in the trouser leg.

In this way, one cycle of sewing operation is completed. The operator having folded the bottom edge of the other of the trouser legs to form the double-layered bottom edge has to place the other of the trouser legs on the sewing machine 1 to form the threefold hem on the other of the trouser legs during the next succeeding cycle of sewing operation.

According to the second embodiment of the present invention, the threefold hem can be obtained in each of the trouser legs with no margin to the seams being curled inside the tubular trouser leg.

Although the present invention has fully been described in connection with the preferred embodiments of the present invention with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A sewing machine for making a threefold hem in each of the legs of a pair of trousers, which comprises:

a sewing needle;

a folding guide rod formed by a round rod and having a straight rod section and a curved rod section extending from one end of said straight rod section in a generally J-shaped configuration, said folding guide rod being positioned forwardly of said needle relative to the stitching direction in which the hem is moved past said needle, said straight rod section being slidably mounted on said sewing machine for being slidable in a direction orthogonal to a line along which stitching is formed as the hem is moved in the stitching direction;

means for moving said folding guide rod from a position in which said curved rod section is spaced laterally of said line with the open part of the curve facing toward said line to a position in which said curved rod section is closer to said line, whereby when the bottom edge of a trouser leg which has been once folded back on itself is engaged in said curved section, said folding guide rod can be moved inwardly toward said line for folding the once folded bottom edge of the trouser leg into a threefold hem;

a detecting plate positioned above said folding guide rod for engaging the trouser leg being stitched and being movable by the seam in the trouser leg for detecting the passage of the seam over said folding guide rod as the trouser leg is being stitched; and stitching operation means to which said detecting plate is connected and connected to said sewing needle to operate said sewing needle upon said detecting plate detecting the initial passage of the seam for causing the sewing machine to initiate a stitching operation from a predetermined position ahead of the seam and after one complete revolution of the trouser leg and upon the detection of further passage of the seam by the detecting plate, causing the sewing machine to terminate the stitching operation at a location a predetermined distance past said predetermined position.

2. A sewing machine as claimed in claim 1 further comprising a revolving roller movably mounted on said sewing machine forwardly of said needle and movable from a position toward said needle to a position away from said needle and in which it engages a trouser leg which has been positioned on said sewing machine for driving the trouser leg pas said needle, and a horizontal bar positioned below said revolving roller and being mounted for rocking movement between a position away from said needle in which it engages a trouser leg which has been positioned on said sewing machine to tension the trouser leg against the sewing machine to a position toward said needle in which it is free of a trouser leg positioned on said sewing machine.

* * * * *